US011791113B2

(12) United States Patent
Lee et al.

(10) Patent No.: US 11,791,113 B2
(45) Date of Patent: Oct. 17, 2023

(54) MULTI-DIRECTIONAL OPERATION SWITCH STRUCTURE

(71) Applicant: ALPS ELECTRIC KOREA CO.,LTD., Gwangju-si (KR)

(72) Inventors: Suk Ho Lee, Gwangju-si (KR); Yoon Jin Jung, Gwangju-si (KR); Se Hyung Oh, Gwangju-si (KR)

(73) Assignee: ALPS ELECTRIC KOREA CO., LTD., Gwangju-si (KR)

( * ) Notice: Subject to any disclaimer, the term of this patent is extended or adjusted under 35 U.S.C. 154(b) by 0 days.

(21) Appl. No.: 17/933,528

(22) Filed: Sep. 20, 2022

(65) Prior Publication Data

US 2023/0106569 A1 Apr. 6, 2023

(30) Foreign Application Priority Data

Oct. 6, 2021 (KR) ..... 10-2021-0132073

(51) Int. Cl.
*H01H 15/16* (2006.01)
*H01H 15/10* (2006.01)

(52) U.S. Cl.
CPC ..... *H01H 15/16* (2013.01); *H01H 15/10* (2013.01)

(58) Field of Classification Search
CPC ..... H01H 15/102; H01H 15/02; H01H 15/06; H01H 15/005; H01H 15/10; H01H 15/18; H01H 15/04; H01H 15/107; H01H 15/00; H01H 15/08; H01H 15/16; H01H 15/105; H01H 15/14; H01H 15/22
See application file for complete search history.

(56) References Cited

U.S. PATENT DOCUMENTS 6,084,192 A 7/2000 Honma
2012/0241295 A1* 9/2012 Huang ..... H01H 15/24 200/330
2013/0140161 A1 6/2013 Gao

FOREIGN PATENT DOCUMENTS

JP 2015-099661 A 5/2015
KR 20-0439215 Y1 3/2008

OTHER PUBLICATIONS

The extended European search report issued by the European Patent Office dated Feb. 27, 2023, which corresponds to European Patent Application No. 22196871.2-1201 and is related to U.S. Appl. No. 17/933,528.

* cited by examiner

*Primary Examiner* — Ahmed M Saeed
(74) *Attorney, Agent, or Firm* — Studebaker & Brackett PC

(57) ABSTRACT

A multi-directional operation switch structure seeks to improve the reliability of a product by minimizing tolerances that need to be managed by making two regions guiding the sliding movement of a slider to be formed by one holder in a switch structure in which a knob is configured on the outside of a casing, and the slider and a holder connected to the knob are inside the casing. Especially, the present disclosure can improve structural stability due to a double support structure and ensure reliability of slider movement by allowing the holder as well as the casing to withstand pressure resulting from external forces. In addition, the present disclosure can simplify a coupling structure and a support structure by configuring the slider to be coupled to the holder in a rotational manner, and the coupled slider to be limited in rotation by the casing.

5 Claims, 8 Drawing Sheets

(a)

(b)

MULTI-DIRECTIONAL OPERATION SWITCH STRUCTURE

CROSS REFERENCE TO RELATED APPLICATION

The present application claims priority to Korean Patent Application No. 10-2021-0132073, filed Oct. 6, 2021, the entire contents of which is incorporated herein for all purposes by this reference.

BACKGROUND OF THE INVENTION

Field of the Invention

The present disclosure relates to a multi-directional operation switch structure and, more particularly, to a multi-directional operation switch structure seeking to improve the reliability of a product by minimizing tolerances that need to be managed by making two regions guiding the sliding movement of a slider to be formed by one holder in a switch structure in which a knob is configured on the outside of a casing, and the slider and a holder connected to the knob are inside the casing.

Especially, the present disclosure relates to a multi-directional operation switch structure capable of improving structural stability due to a double support structure and ensuring reliability of slider movement by allowing the holder as well as the casing to withstand pressure resulting from external forces.

Description of the Related Art

As the functions of electronic products are diversified and an area occupied by a control panel for operating those functions increases, technologies are being developed that allow the use of a single switch to perform various functions.

In the case of a vehicle, as a large number of electronic control systems are mounted, switches are applied for the convenience of a driver's operation. One example of switches of various structures that have been used so far is shown in FIG. 1.

Referring to FIG. 1, a holder 10 that protects components including a PCB board on which electronic elements such as switching elements are mounted, a slider 20 coupled to a knob 40, and a casing 30 are sequentially stacked.

Accordingly, when the knob 40 is operated (moved in the left and right direction in FIG. 1), the slider 20 reciprocates between the holder 10 and the casing 30 in a sliding manner. Yet, this type of switch has the following problems.

First, since it is a structure in which three components are sequentially stacked, tolerance accumulation by three parts (d1 to d3) is significant as shown in FIG. 2 (*a*), and this not only lowers product reliability, but also causes difficulties in tolerance management in manufacturing.

In other words, since the slider 20 is interposed between the holder 10 and the casing 30, there exists a tolerance between the slider 20 and the holder 10 and a tolerance between the slider 20 and the casing 30.

Second, as shown in FIG. 2 (*b*), when an external force is applied to the outside of part 'a' and a pressing phenomenon occurs in the casing 30, the casing 30 of 'a' part presses the slider 20, and as a result, the slider 20 is pressed by the holder 10 and the casing 30.

Due to this, an undesired restriction occurs in the movement of the slider 20, and even if a user operates the knob 40, a desired function may not be selected or adjusted.

As another example of the conventional switches, there is a "SLIDE SWITCH MODULE" (hereinafter referred to as "related art") in Korean Utility Model Registration No. 20-0439215, which is the following related art document.

In the related art, a structure is applied in which a slider guide configured in a slider is inserted into a slider guide entry groove formed in the upper direction and then moved in the horizontal direction along a slider guide accommodation groove to be coupled.

However, in this case of the related art, there is a problem in that, in the process of using a switch, when the slider 220 moves irregularly due to external vibration, etc., and the slider guide moves to the position of the slider guide entry groove, the slider is separated.

Documents of Related Art (Patent Document 0001) Korean Utility Model Registration No. 20-0439215 "SLIDE SWITCH MODULE"

SUMMARY OF THE INVENTION

Accordingly, the present disclosure has been made keeping in mind the above problems occurring in the related art, and the present disclosure is intended to provide a multi-directional operation switch structure that improves the reliability of a product by minimizing tolerances that need to be managed by making two regions guiding the sliding movement of a slider to be formed by one holder in a switch structure in which a knob is configured on the outside of a casing, and the slider and a holder connected to the knob are inside the casing.

Especially, an objective of the present disclosure is to provide a multi-directional operation switch structure capable of improving structural stability due to a double support structure and ensuring reliability of slider movement by allowing the holder as well as the casing to withstand pressure resulting from external forces.

In addition, an objective of the present disclosure is to provide a multi-directional operation switch structure capable of improving the ease of a manufacturing process and productivity of a product by simplifying a coupling structure and a support structure by configuring the slider to be coupled to the holder in a rotational manner, and the coupled slider to be limited in rotation by the casing.

In order to achieve the above objective, according to an embodiment of the present disclosure, there is provided a multi-directional operation switch structure, including: a casing; a slider at least a portion of which penetrates through the casing and is exposed to an outside to be coupled to a knob; and a holder configured to protect an internal component including at least another portion of the slider, wherein the holder may be configured to guide a movement of the slider.

The holder may include: a lower movement limitation part for restricting a movement in a downward direction of the slider; and an upper movement limitation part for restricting a movement in an upward direction of the slider.

The lower movement limitation part and the upper movement limitation part may be arranged to be staggered in a top view.

The lower movement limitation part may be provided in a center of the holder, while the upper movement limitation part may be provided around the lower movement limitation part at an outside thereof.

The upper movement limitation part may be configured as two in a symmetrical structure with the lower movement limitation part as the center.

The two upper movement limitation parts may be formed with an opening that opens in a first rotational direction on a plane.

At least one of the two upper movement limitation parts may be formed with a rotation limitation part in a second rotational direction.

The casing may be formed with a through hole through which at least the portion of the slider passes, and the slider may be limited in rotation by the through hole.

The slider may include: a body part disposed in the lower movement limitation part; and a wing part disposed in the upper movement limitation part.

The body part may be configured to pivot about a center of the lower movement limitation part, and the wing part may rotate to the upper movement limitation part through the opening while rotating by a pivoting of the body part.

As described above, a multi-directional operation switch structure of the present disclosure has an effect of improving the reliability of a product by minimizing tolerances that need to be managed by making two regions guiding the sliding movement of a slider to be formed by one holder in a switch structure in which a knob is configured on the outside of a casing, and the slider and a holder connected to the knob are inside the casing.

In other words, the present disclosure has an effect of improving the ease and efficiency of tolerance management and reducing the part management costs by reducing the number of parts that require tolerance management from three to two.

Especially, the present disclosure has an advantage of improving structural stability due to a double support structure and ensuring reliability of slider movement by allowing the holder as well as the casing to withstand pressure resulting from external forces.

Through this, the present disclosure has an advantage of not only semi-permanently extending the life of a product, but also sufficiently ensuring the operability and functionality of a switch even in long-term use.

In addition, the present disclosure has an advantage of simplifying a coupling structure and a support structure by configuring the slider to be coupled to the holder in a rotational manner, and the coupled slider to be limited in rotation by the casing.

Through this, the present disclosure has an advantage of improving the ease of operation and productivity of a product in the manufacturing process.

Accordingly, reliability and competitiveness can be improved in the field of electronic switches, particularly multi-function switches and multi-directional switches, and automotive switches, as well as similar or related fields.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Examples of a multi-directional operation switch structure according to the present disclosure may be applied in various ways, and the most preferred embodiment will be described below with reference to the accompanying drawings.

Figure 3:
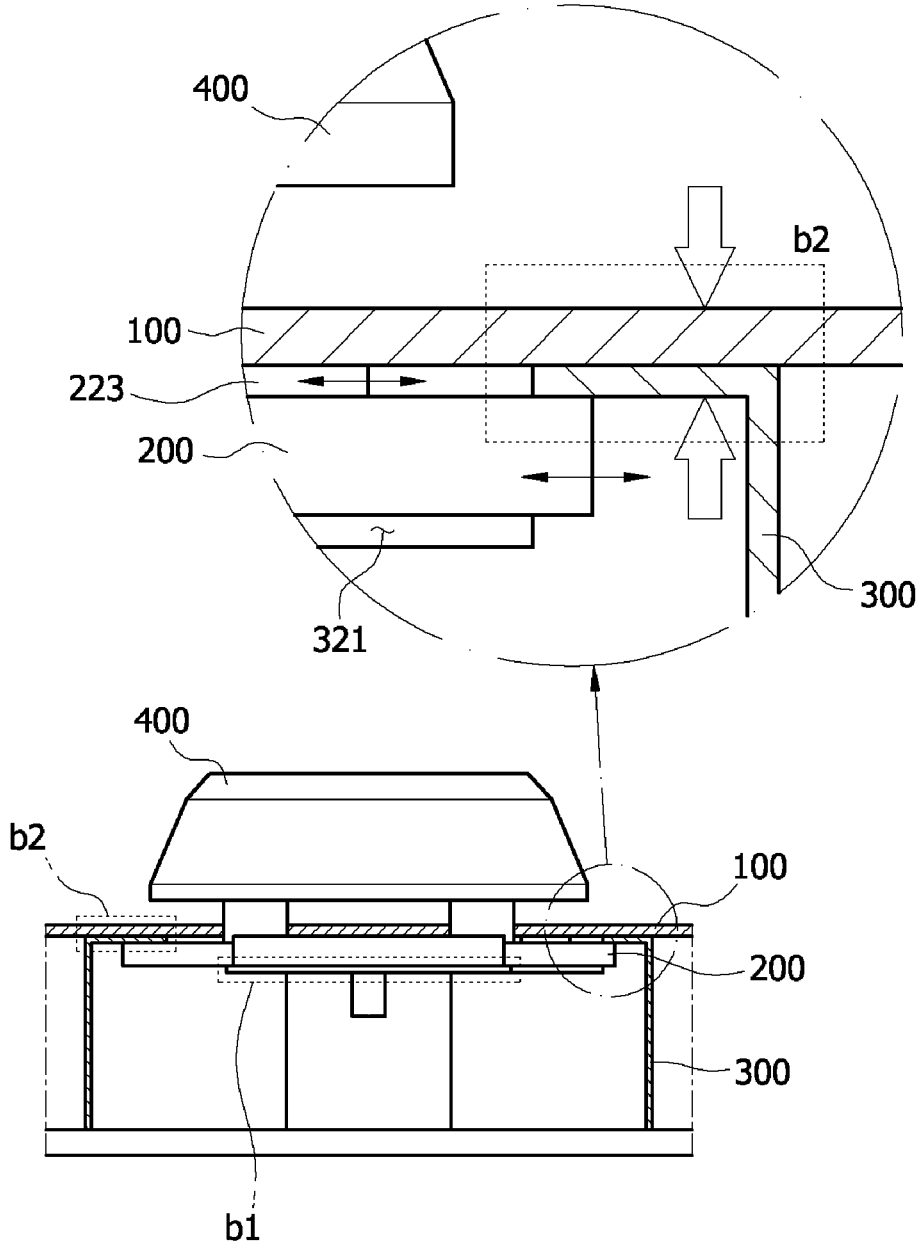
FIG. 3 is a block diagram showing an embodiment of a multi-directional operation switch structure according to the present disclosure.

FIG. 3 is a block diagram showing an embodiment of a multi-directional operation switch structure according to the present disclosure.

Referring to FIG. 3, a multi-directional operation switch includes a casing 100, a slider 200, a holder 300, and a knob 400.

The casing 100 forms the outer shape of a portion where the knob 400 is installed, and in the case of a vehicle, the casing 100 may include interior materials.

The slider 200 is configured such that at least a portion thereof penetrates through the casing 100 and is exposed to the outside, and is coupled with the knob 400 at the exposed portion. The slider 200 may slide in various directions in response to the knob 400 being manipulated by a user.

The holder 300 is configured to protect internal components including at least another portion of the slider, and may serve to protect a switching element turned on and off by the movement of the slider 200, a sensor element sensing the movement of the slider 200, and a PCB substrate on which various elements are mounted.

As for the internal components including the switching element, the sensor element, and the PCB substrate and electrical coupling relationships, various types may be applied according to the function and structure of the multi-directional operation switch of the present disclosure, it is not limited to a specific one.

As previously described, in the conventional multi-directional switch, the slider is guided by the holder at the lower part and is guided by the casing at the upper part. In contrast, a technical feature of the present disclosure is that it is configured to guide the movement of the slider 200 only by the holder 300.

In other words, as shown in FIG. 3, both the lower part b1 and the upper part b2 of the slider 200 may be guided by the holder 300, which will be described in more detail below.

Figure 4:
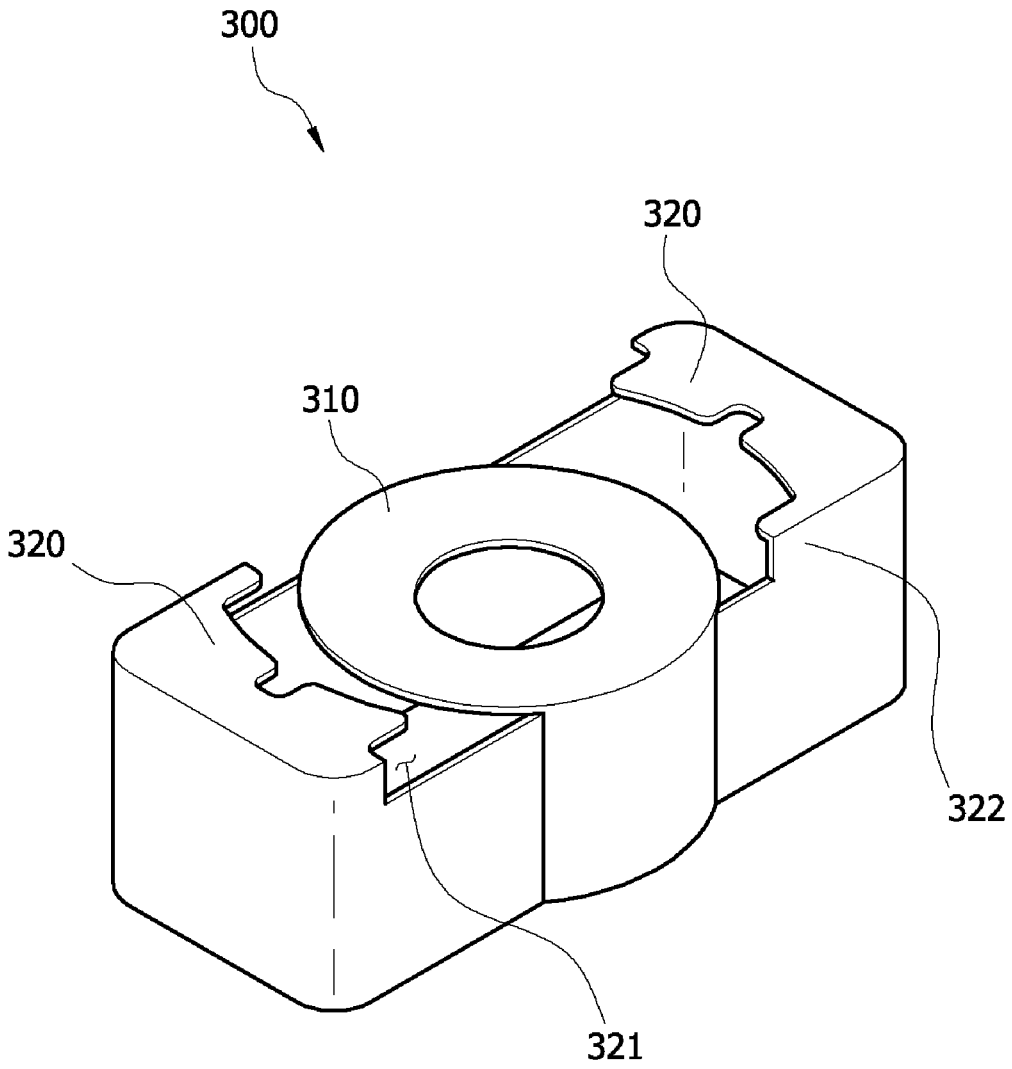
FIG. 4 is a perspective view illustrating a holder shown in FIG. 3.

FIG. 4 is a perspective view illustrating a holder shown in FIG. 3.

Referring to FIG. 4, the holder 300 may include: a lower movement limitation part 310 for restricting a movement in a downward direction of the slider 200; and an upper movement limitation part 320 for restricting a movement in an upward direction of the slider 200.

To be specific, the downward movement of the slider 200 may be restricted by the upper surface of the lower movement limitation part 310, while the upward movement of the slider 200 may be restricted by the lower surface of the upper movement limitation part 320.

Figure 1:
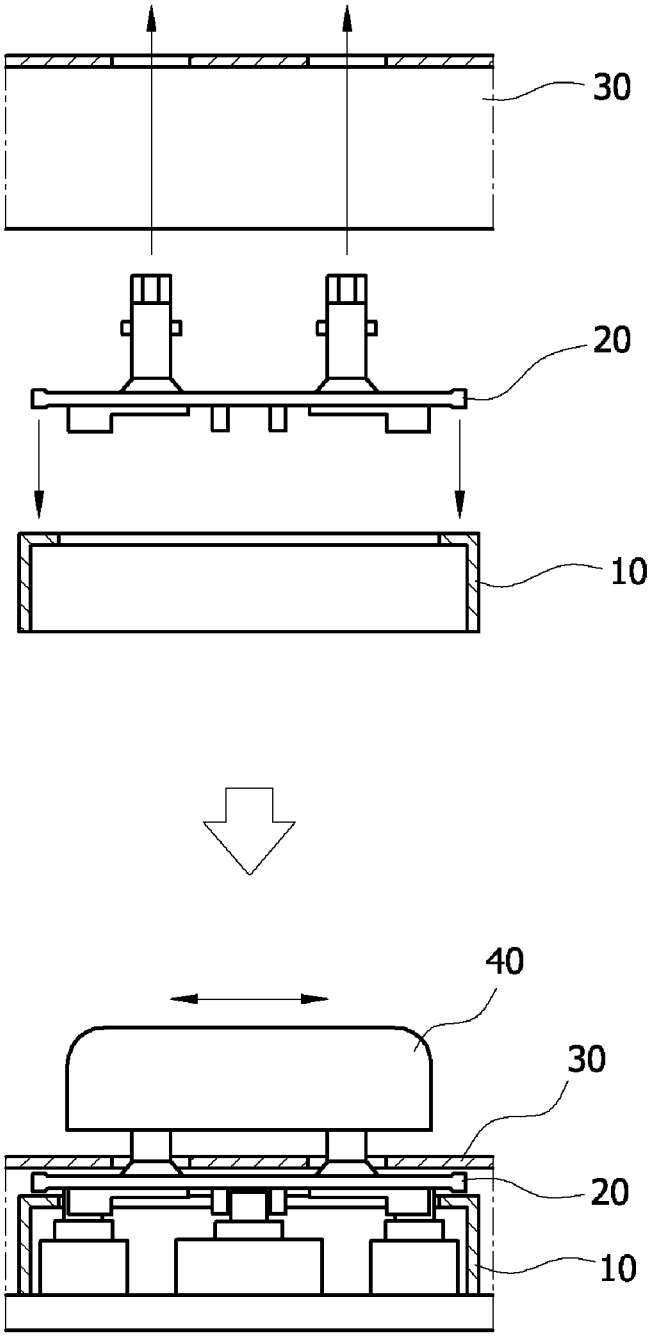
FIG. 1 is a view illustrating a conventional switch structure.
Figure 2:
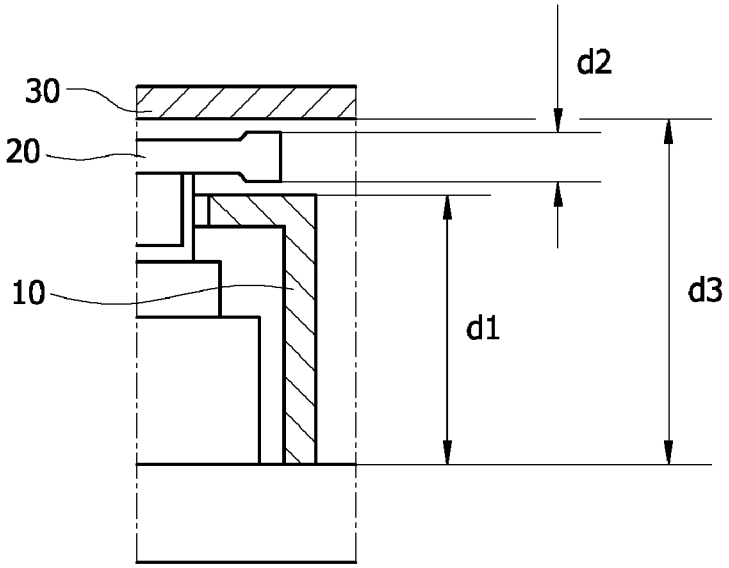
FIG. 2 is a view illustrating problems of the structure in FIG. 1.
Figure 2:
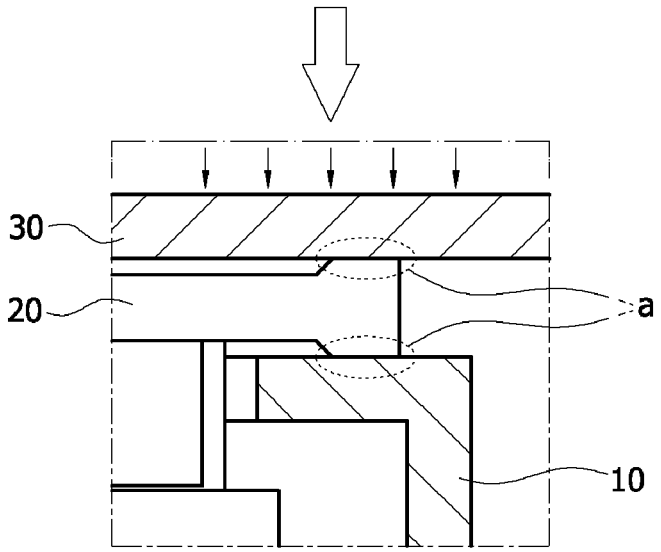

Meanwhile, as shown in FIG. 2, in the conventional art, it can be seen that the slider is unable move smoothly as the lower and upper surfaces of the slider are simultaneously pressed by the holder and the casing at point 'a', respectively.

Accordingly, in the present disclosure, in order to prevent the lower movement limitation part 310 and the upper movement limitation part 320 from simultaneously pressing the slider 200 in the upward and downward directions, it is preferable that the lower movement limitation part 310 and the upper movement limitation part 320 are arranged to be staggered as shown in FIG. 4 when viewed from a top view.

For example, the lower movement limitation part 310 may be formed in the center of the holder 300, while the upper movement limitation part 320 may be formed around the lower movement limitation part 310 at the outside thereof.

At this time, it is desirable that in the holder 300, two upper movement limitation parts 320 are formed in a symmetrical structure with the lower movement limitation part 310 as the center in order to prevent the coupled slider 200 from inclining in a certain direction.

In addition, the two upper movement limitation parts 320 may be formed with an opening 321 that is opened in one rotational direction (counterclockwise in FIG. 4) on the plane.

Moreover, at least one of the two upper movement limitation parts 320 may be formed with a rotation limitation part 322 in the other one rotational direction (clockwise in FIG. 4).

Figure 5:
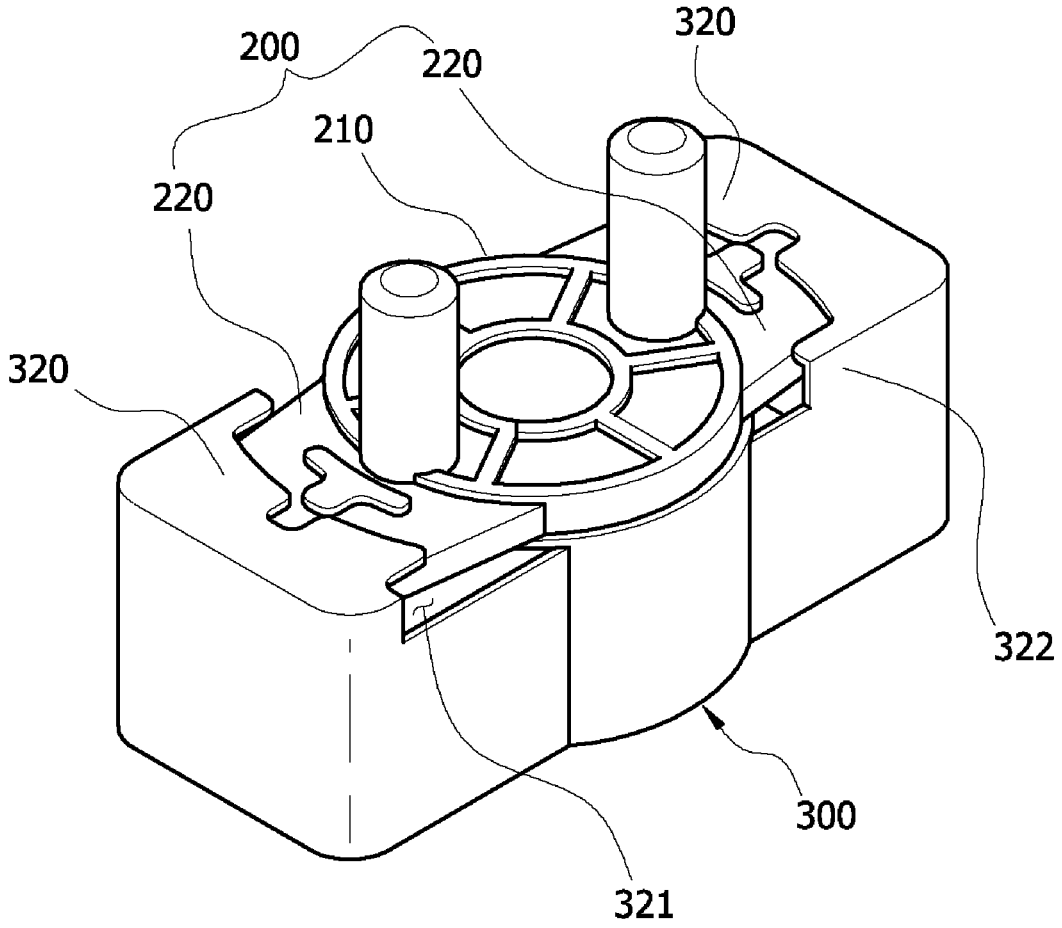
FIG. 5 is a perspective view illustrating a state in which a slider is coupled to the holder shown in FIG. 3.
Figure 6:
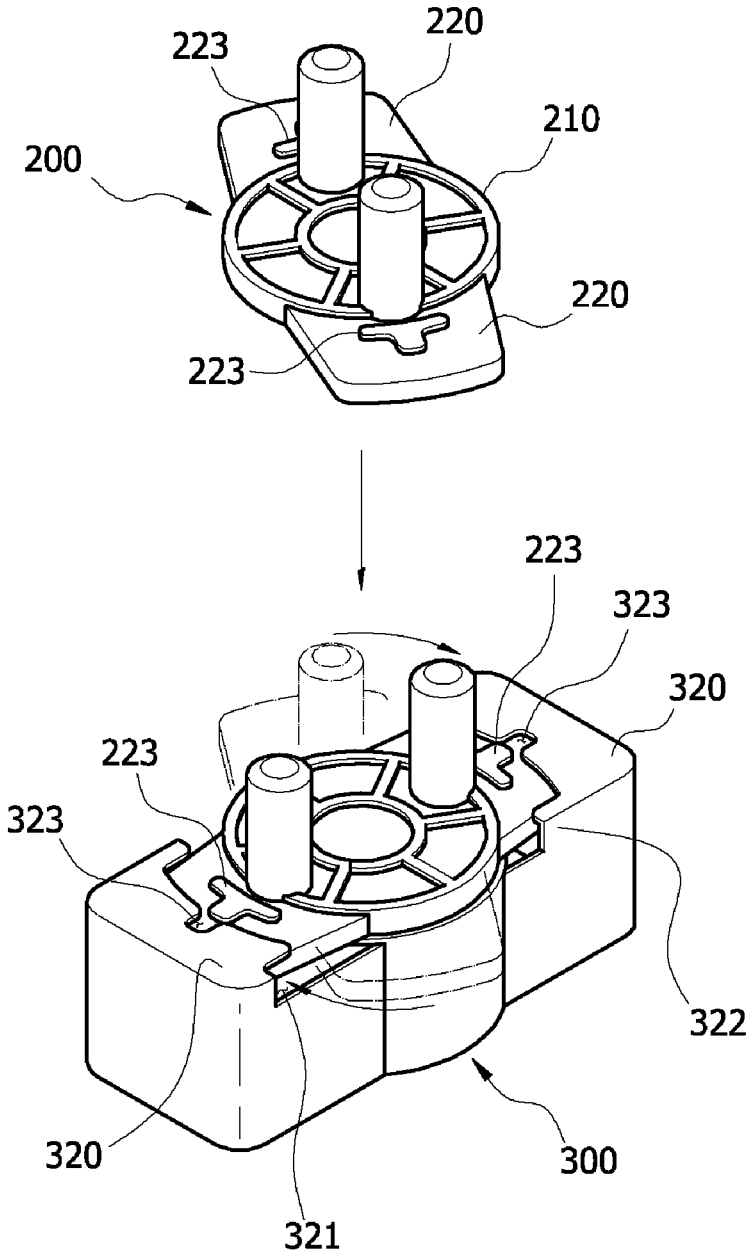
FIG. 6 is a perspective view illustrating a process in which the slider is coupled to the holder shown in FIG. 3.

FIG. 5 is a perspective view illustrating a state in which a slider is coupled to the holder shown in FIG. 3, and FIG. 6 is a perspective view illustrating a process in which the slider is coupled to the holder shown in FIG. 3.

Referring to FIG. 5, the slider 200 may include a body part 210 and a wing part 220.

The body part 210 is disposed on the lower movement limitation part 310 of the holder 300, and may be formed in a disk shape and be configured to be axially rotatable on the plane based on a virtual central axis formed in the vertical direction.

The wing part 220 is disposed on the upper movement limitation part 320, and may be formed on each side of the body part 210.

Accordingly, as shown in FIG. 6, in the slider 200, the body part 210 may pivot about the center of the lower movement limitation part, and the wing part rotates to the upper movement limitation part through the opening while rotating by a pivoting of the body part.

At this time, the opening 321 is preferably formed in both upper movement limitation parts 320 so that both wing parts 220 pass through the opening 321, and the rotation limitation part 322 may be formed in at least one of the two upper movement limitation parts 320 because the rotation limitation part 322 may limit only the movement of any one of the two wing parts 220.

Meanwhile, in FIG. 6, unexplained reference numerals '223' and '323' are guide protrusions and guide grooves, respectively, and are for guiding the coupled slider 200 when it moves in one direction (from the lower left to the upper right in FIG. 6).

Figure 7:
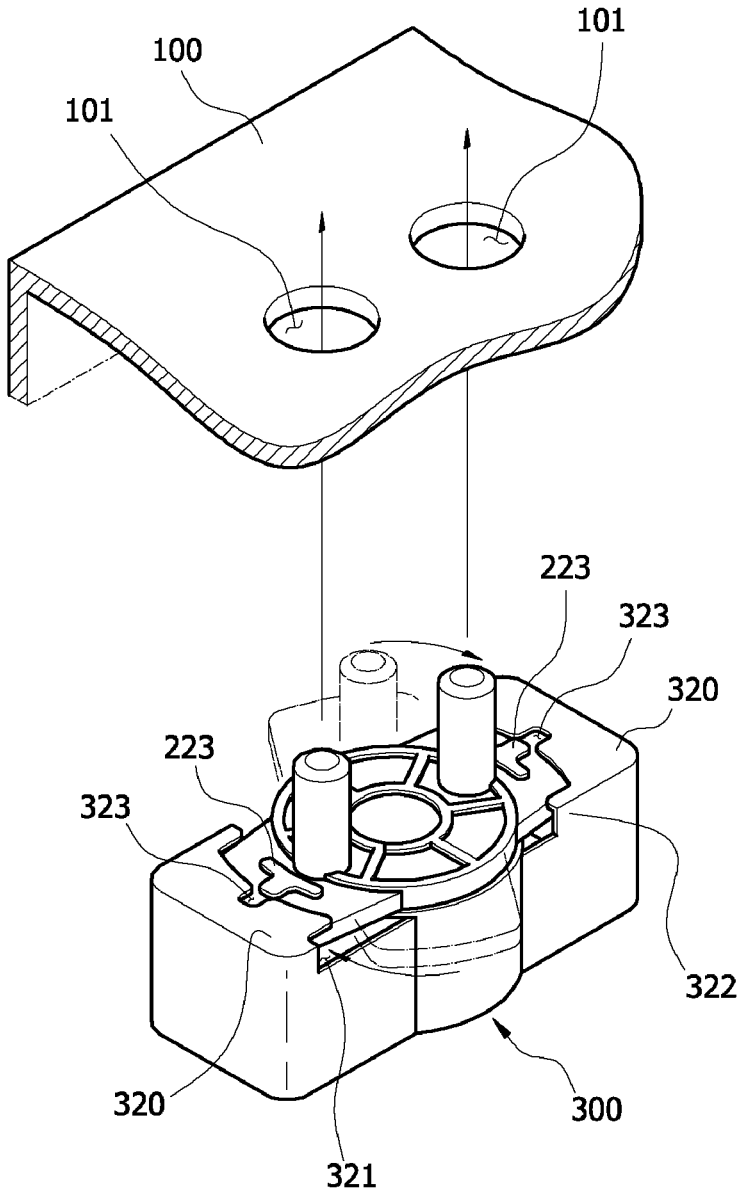
FIG. 7 is a view illustrating a process in which each component shown in FIG. 3 is combined.

FIG. 7 is a view illustrating a process in which each component shown in FIG. 3 is combined.

Referring to FIG. 7, at least one through hole 101 may be formed in the casing 100 to correspond to the shape and structure of the slider 200.

As previously described in FIG. 6, when the slider 200 is rotated and coupled to the holder 300, the casing 100 may be coupled to the slider 200 and the holder 300 such that at least a portion of the slider 200 is exposed to the outside through the through hole 101.

In addition, as shown in FIG. 3, a knob 400 may be coupled to the slider 200 exposed through the through hole 101.

Meanwhile, since the slider 200 is rotated and coupled to the holder 300, if the slider rotates in the opposite direction to the coupling direction after coupling, a situation in which the slider 200 is separated from the holder 300 may occur.

Accordingly, in the present disclosure, by restricting the rotation of the slider 200 by the through hole 101, it is possible to prevent the slider 200 from being separated after coupling.

Figure 8:
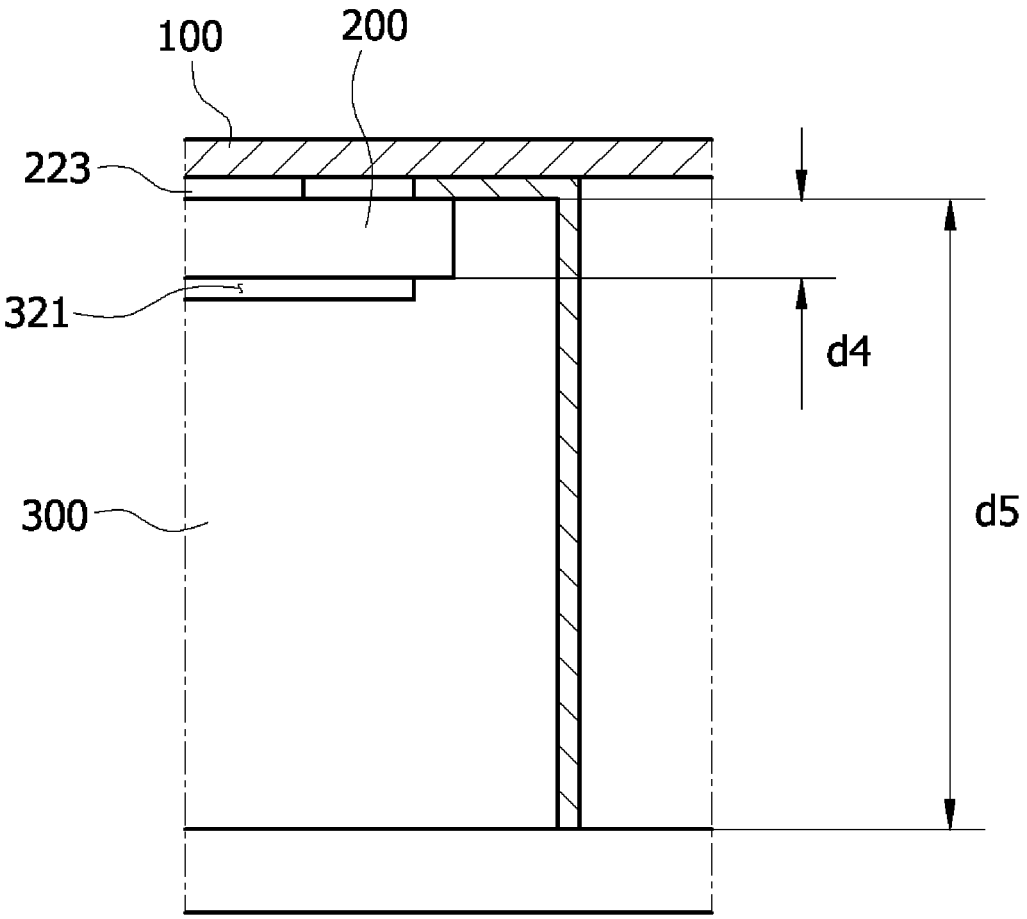
FIG. 8 is a view illustrating the technical features of the present disclosure in comparison with the structure in FIG. 2.

FIG. 8 is a view illustrating the technical features of the present disclosure in comparison with the structure in FIG. 2.

Referring to FIG. 8, in the present disclosure, since the configuration involved in the movement of the slider 200 is the holder 300 and the casing 100 is irrelevant, tolerance management may also be sufficient by managing only two parts (d4, d5) of the slider 200 and the holder 300.

In addition, when an external force is applied from the outside of the casing 100, the casing 100 primarily withstands the pressure and the holder 300 withstands the pressure secondarily as shown in the enlarged part of FIG. 3, so that the slider 200 may be operated stably.

Thus, the multi-directional operation switch structure of the present disclosure may improve the reliability of a product by minimizing tolerances that need to be managed, improve structural stability due to a double support structure, and ensure reliability of the movement of the slider 200.

In the above, the multi-directional operation switch structure of the present disclosure has been described. Those skilled in the art to which the present disclosure pertains will understand that the technical configuration of the present disclosure may be implemented in other specific forms without changing the technical spirit or essential characteristics of the present disclosure.

Therefore, it should be understood that the embodiments described above are illustrative in all respects and not restrictive.

What is claimed is:

1. A multi-directional operation switch structure, comprising:

a casing;

a slider at least a portion of which penetrates through the casing and is exposed to an outside to be coupled to a knob; and a holder configured to protect an internal component including at least another portion of the slider, wherein the holder is configured to guide a movement of the slider, wherein the holder comprises:

a lower movement limitation part for restricting a movement in a downward direction of the slider; and an upper movement limitation part for restricting a movement in an upward direction of the slider, wherein the lower movement limitation part and the upper movement limitation part are arranged to be staggered in a top view, wherein the lower movement limitation part is provided in a center of the holder, while the upper movement limitation part is provided around the lower movement limitation part at an outside thereof, wherein the upper movement limitation part is configured as two in a symmetrical structure with the lower movement limitation part as the center, and wherein the two upper movement limitation parts are formed with an opening that opens in a first rotational direction on a plane.

2. The multi-directional operation switch structure of claim 1, wherein at least one of the two upper movement limitation parts is formed with a rotation limitation part in a second rotational direction.

3. The multi-directional operation switch structure of claim 1, wherein the casing is formed with a through hole through which at least the portion of the slider passes, and the slider is limited in rotation by the through hole.

4. The multi-directional operation switch structure of claim 1, wherein the slider comprises:

a body part disposed in the lower movement limitation part; and a wing part disposed in the upper movement limitation part.

5. The multi-directional operation switch structure of claim 4, wherein the body part is configured to pivot about a center of the lower movement limitation part, and the wing part rotates to the upper movement limitation part through the opening while rotating by a pivoting of the body part.

* * * * *